US007980036B2

(12) United States Patent
Takayasu et al.

(10) Patent No.: US 7,980,036 B2
(45) Date of Patent: Jul. 19, 2011

(54) LINING STRUCTURE

(75) Inventors: Teruki Takayasu, Ikoma (JP); Kinji Onoda, Ikoma (JP); Ryosuke Matsuoka, Ikoma (JP); Eiji Owaki, Tokyo (JP); Asuko Kimoto, Tokyo (JP)

(73) Assignee: Showa Co., Ltd. (JP)

( * ) Notice: Subject to any disclaimer, the term of this patent is extended or adjusted under 35 U.S.C. 154(b) by 223 days.

(21) Appl. No.: 11/576,809

(22) PCT Filed: Apr. 14, 2005

(86) PCT No.: PCT/JP2005/007258
§ 371 (c)(1),
(2), (4) Date: Apr. 5, 2007

(87) PCT Pub. No.: WO2006/040849
PCT Pub. Date: Apr. 20, 2006

(65) Prior Publication Data

US 2007/0277464 A1 Dec. 6, 2007

(30) Foreign Application Priority Data

Oct. 8, 2004 (JP) ..... 2004-296684
Jan. 27, 2005 (JP) ..... 2005-020031

(51) Int. Cl.
*E04C 2/38* (2006.01)

(52) U.S. Cl. ..... 52/506.01; 52/588.1; 52/592.1

(58) Field of Classification Search ..... 52/523, 52/527, 539, 518, 519, 556, 588.1, 506.05, 52/506.01, 510, 311.2, 592.1, 592.2, 747.11, 52/747.13, 748.1
See application file for complete search history.

(56) References Cited

U.S. PATENT DOCUMENTS 712,093 A * 10/1902 Randel ..... 52/556
816,252 A * 3/1906 Price ..... 52/533
841,490 A * 1/1907 Montier ..... 52/591.2
1,298,541 A * 3/1919 Miller ..... 52/556
RE18,785 E * 4/1933 Currie ..... 138/147
2,103,076 A * 12/1937 Harshberger et al. ..... 52/519
2,239,011 A * 4/1941 Meslin ..... 52/506.1
(Continued)

FOREIGN PATENT DOCUMENTS

EP 0466928 A1 1/1992
(Continued)

OTHER PUBLICATIONS

English Translation of International Search Report for PCT/JP2005/007258, dated Jun. 15, 2005.

*Primary Examiner* — Robert J Canfield
*Assistant Examiner* — Christine T Cajilig
(74) *Attorney, Agent, or Firm* — Knobbe Martens Olson & Bear LLP

(57) ABSTRACT

The lining structure of the present invention comprises lining plates each having supporting portions formed at two opposite sides of a square lining plate body via bent step portions, and covering portions formed at the remaining sides of the lining plate body; the lining plates being arranged in longitudinal and transverse directions on a surface to be lined; in the first and second lining plates that are adjacent to each other in longitudinal and transverse directions, a covering portion of one of the lining plates being superposed on a supporting portion of, and being butted against the lining plate body of, another of the lining plates, with the butted portion being joined by welding, with an adhesive, or a combination thereof.

14 Claims, 13 Drawing Sheets

U.S. PATENT DOCUMENTS

| | | | | | |
|---|---|---|---|---|---|
| 2,329,719 | A | * | 9/1943 | Hewett | 52/265 |
| 2,411,308 | A | * | 11/1946 | Washburn | 52/519 |
| 2,454,307 | A | * | 11/1948 | Cooley | 52/591.3 |
| 2,462,990 | A | * | 3/1949 | Noian et al. | 52/553 |
| 2,490,577 | A | * | 12/1949 | Brown | 52/591.1 |
| 2,649,172 | A | * | 8/1953 | Allen | 52/591.4 |
| 2,685,852 | A | * | 8/1954 | Godel | 52/16 |
| 2,851,134 | A | * | 9/1958 | Robinson, Jr. | 52/506.1 |
| 2,914,815 | A | * | 12/1959 | Alexander | 52/592.1 |
| 2,961,804 | A | * | 11/1960 | Beckman | 52/539 |
| 3,875,714 | A | * | 4/1975 | Nayler et al. | 52/309.4 |
| 3,877,190 | A | * | 4/1975 | Corcoran, Jr. | 52/506.08 |
| 4,065,902 | A | * | 1/1978 | Lindal | 52/782.1 |
| 4,458,458 | A | * | 7/1984 | Orii | 52/173.1 |
| 4,501,100 | A | * | 2/1985 | Corna et al. | 52/169.7 |
| 4,680,909 | A | * | 7/1987 | Stewart | 52/409 |
| 4,766,022 | A | * | 8/1988 | Tone | 428/95 |
| 5,136,823 | A | * | 8/1992 | Pellegrino | 52/539 |
| 5,495,654 | A | * | 3/1996 | Goodhart et al. | 29/527.4 |
| 5,613,337 | A | * | 3/1997 | Plath et al. | 52/533 |
| 5,657,603 | A | * | 8/1997 | Goodhart et al. | 52/519 |
| 6,173,546 | B1 | * | 1/2001 | Schafer | 52/522 |
| 6,463,708 | B1 | * | 10/2002 | Anderson | 52/521 |
| 6,505,451 | B1 | * | 1/2003 | Ksajikian | 52/518 |
| 6,557,315 | B2 | * | 5/2003 | Tremblay | 52/552 |
| RE38,210 | E | * | 8/2003 | Plath et al. | 52/533 |
| 2008/0302053 | A1 | * | 12/2008 | Gibson et al. | 52/588.1 |

FOREIGN PATENT DOCUMENTS

| | | | | |
|---|---|---|---|---|
| JP | 62446 | C2 | | 2/1925 |
| JP | 14-16125 | Y1 | | 11/1939 |
| JP | 06-234582 | A | | 4/1994 |
| JP | 06-240840 | A | | 8/1994 |
| JP | 06307059 | A | * | 11/1994 |
| JP | 2001-071128 | A | | 3/2001 |
| WO | WO 81/00993 | | | 4/1981 |

* cited by examiner (a)

(b)

(c)

(d)

(a)

(b)

(c)

(a)

(b)

(c)

(a)

(b)

(c)

LINING STRUCTURE

CROSS-REFERENCE TO RELATED APPLICATIONS

This application claims to benefit and priority to and is a U.S. National Phase of PCT International Application Number PCT/JP2005/007258, filed on Apr. 14, 2005, designating the United States of America, which claims priority under 35 U.S.C. §119 to Japanese Application 2004-296684 filed on Oct. 8, 2004 and Japanese Application Number 2005-020031 filed on Jan. 27, 2005. The disclosures of the above-described applications are hereby incorporated by reference in their entirety.

TECHNICAL FIELD

The present invention relates to a lining structure for concrete constructions, steel constructions, wood constructions, etc.

BACKGROUND ART

Linings that shield the surfaces of concrete constructions, steel constructions, wood constructions, etc., from the environment are used for various purposes. When lining plates are used, they need to be butted against each other and therefore are likely to be misaligned.

Since concrete constructions, steel constructions, and wood constructions may have poor corrosion resistance in certain installation environments, methods have been proposed to protect such constructions using suitable corrosion-resistant materials.

For example, concrete constructions are deteriorated by salt damage, neutralization, the actions of acidic substances such as sulfuric acid, chemical erosion, and other chemical actions, and therefore it has been proposed to use titanium, which has excellent corrosion resistance, as a protective material for concrete constructions such as water tanks in water-and-sewage facilities, which are subjected to the above actions.

Specifically, a technique for forming a titanium thin film on the surface of a concrete construction by evaporation has been proposed (Patent Document 1). Also proposed is a technique in which titanium sheets are arranged as lining sheets on the surface of a concrete construction so that the ends of adjacent lining sheets are butted against each other, and support plates are placed at the butted portions to join the lining plates by TIG welding (Patent Document 2).

The former technique, however, has a drawback in that the titanium layer is extremely thin and is likely to be damaged by physical stimuli such as the impact of abrasion produced by gravel, resulting in exposure of the concrete construction. The latter technique can employ thick titanium sheets and thus can impart high strength against physical stimuli, but poses a problem of low operating efficiency since the titanium sheets must be welded while applying support plates.

Welding techniques using lining plates also pose problems in that, when the lining plates are welded to each other on a concrete construction, heat generated during the welding melts the concrete, and that thin lining plates cannot be used, as well as the above-mentioned problem of lining plate misalignment. There is also a problem in that the welded portions are linear and are thus liable to be broken when subjected to stress.

Also proposed is a lining structure in which square lining plates having bent portions formed along all sides, and triangular lining plates, are joined together (Patent Document 3). However, corrosion-resistant materials, such as corrosion-resistant metals, corrosion-resistant alloys containing corrosion-resistant metals as main components, and the like, that have been processed by rolling, have poor bending properties in a direction perpendicular to the rolling direction, and therefore are usually bent only in a direction parallel to the rolling direction. Thus, it is difficult to apply the above technique, in which bending is performed along all the sides, to the rolled corrosion-resistant materials mentioned above.

[Patent Document 1] Japanese Unexamined Patent Application Publication No. 1994-234582

[Patent Document 2] Japanese Unexamined Patent Application Publication No. 2001-71128

[Patent Document 3] Japanese Unexamined Patent Application Publication No. 1994-240840

DISCLOSURE OF THE INVENTION

Problems to be Solved by the Invention

The present invention was achieved in view of the above-mentioned circumstances. A first object of the present invention is to provide a lining structure that enables reliable joining by welding when using metallic lining plates, and that improves the efficiency of lining, by providing lining plates with supporting portions for joining and using the supporting portions as backing plates for the butted portions of the lining plates. A second object of the present invention is to provide a lining structure having improved watertightness by configuring the lining structure so that the supporting portions restrict each other's movement and thereby suppress misalignment of the lining plates, regardless of the material of the lining plates.

Means for Solving the Problems

To achieve the above objects, the lining structure of the present invention comprises lining plates each having supporting portions formed at two opposite sides of a square lining plate body via bent step portions, and covering portions formed at the remaining sides of the lining plate body; the lining plates being arranged in longitudinal and transverse directions on a surface to be lined; in the lining plates that are adjacent to each other in longitudinal and transverse directions, a covering portion of one of the lining plates being superposed on a supporting portion of, and being butted against a covering portion of, another of the adjacent lining plates, with the butted portion being joined by welding, with an adhesive, or a combination thereof.

It is desirable to configure the lining plates as follows. The lining plates include first and second lining plates each having supporting portions extending from two opposite sides of a square lining plate body via bent step portions, and covering portions extending from the remaining sides of the lining plate body. Each first lining plate has protruding portions protruding from the ends of the supporting portions in the directions along the supporting portion-extending sides of the lining plate body; and each second lining plate has spaces that are located at the sides of the ends of its supporting portions and that have a different level from the covering portions, the spaces being used as introduction portions for introducing the supporting portions and protruding portions of the first lining plates. The first and second lining plates are alternately arranged in longitudinal and transverse directions on a surface to be lined, forming a staggered pattern. In the first and second lining plates that are adjacent to each other in longitudinal and transverse directions, a covering portion of one of the lining plates is superposed on a supporting portion of, and is butted against the lining plate body of, another of the lining plates, while a protruding portion of a supporting portion of the first lining plates underlies a covering portion of the second lining plates through an introduction portion of the second lining plate, and is located between ends of supporting portions of the second lining plates that are adjacent to each other in a diagonal direction, so that the supporting portions and protruding portions restrict the movement of the lining plates.

Each lining plate is desirably formed by bending a square or nearly square corrosion-resistant metal plate.

It is also desirable that each lining plate be formed of a corrosion-resistant metallic material, a corrosion-resistant alloy material containing a corrosion-resistant metal as a main component, or a metallic material which has been made corrosion-resistant by coating with a corrosion-resistant material or by surface treatment. The bent step portions are desirably formed by bending in the rolling direction.

The corrosion-resistant metallic material and corrosion-resistant alloy material preferably comprise titanium and an alloy containing titanium as a main component, respectively.

It is also desirable that the corrosion-resistant alloy material comprise a stainless steel material.

Further, it is desirable that the lining plates be formed of a metallic material, which preferably has protective properties such as abrasion resistance, heat resistance, etc., and good design properties.

Each lining plate is desirably formed by bending a square or nearly square metal plate.

It is desirable that the lining plates be formed of a non-metallic material or a composite of metallic and non-metallic materials. These materials preferably have protective properties such as abrasion resistance, heat resistance, etc., and good design properties.

The non-metallic material is preferably a plastic, FRP, or ceramic.

It is preferable that the surface to be lined be an internal or external surface of a concrete construction, or both.

It is also preferable that the surface to be lined be an internal or external surface of a steel construction, or both.

It is also preferable that the surface to be lined be an internal or external surface of a wood construction, or both.

It is preferable that the supporting portions of the first and second lining plates be fixed to the surface to be lined, with anchor bolts or adhesive layers.

It is also preferable that the lining plate bodies of the first and second lining plates be fixed to the surface to be lined, with anchor bolts or adhesive layers.

Effects of the Invention

In the lining structure of the present invention, each lining plate has supporting portions formed at two opposite sides of a square lining plate body via bent step portions, and covering portions formed at the remaining sides of the lining plate body. Since a covering portion of one of the lining plates is superposed on a supporting portion of, and is butted against the lining plate body of, another of the lining plates, the supporting portions are in contact with and restrict each other to prevent displacement of the lining plates, thereby preventing undesirable opening of the joints of the lining plates and improving the watertightness of the joints. Further, such a positioning function of the supporting portions can improve the lining accuracy.

Further, the lining plates of the lining structure of the present invention include first and second lining plates, each of which has supporting portions extending from two opposite sides of a square lining plate body via bent step portions, and covering portions extending from the remaining sides of the lining plate body. Each of the first lining plates has protruding portions extending from the ends of its supporting portions in extending directions of the supporting portion-bearing sides of the lining plate body; and each of the second lining plate has spaces that are located at the sides of the ends of its supporting portions and that have a different level from its covering portions, the spaces being used as introduction portions for introducing supporting portions and protruding portions. The first and second lining plates are alternately arranged in longitudinal and transverse directions on the surface to be lined, forming a staggered pattern. In the first and second lining plates adjacent to each other in the longitudinal and transverse directions, a covering portion of one of the lining plates is superposed on a supporting portion of, and is butted against the lining plate body of, another lining plate, while a protruding portion of a supporting portion of the first lining plates underlies a covering portion of the second lining plate through an introduction portion of the second lining plate, and is located between ends of supporting portions of the second lining plates that are adjacent to each other in a diagonal direction, so that the lining plates mutually restrict their movement via the supporting portions and protruding portions. Such a configuration not only makes lining plate displacement unlikely and thereby improves watertightness reliability, but also ensures welding or adhesion due to the presence of the supporting portions on the backside and thereby further improves watertightness reliability and the lining accuracy.

When the lining plates are formed of a metallic material, such as a corrosion-resistant metal or the like, the butted portions of the lining plates can be joined by welding. In such a case, the supporting portions serve as support plates (back plates) of the butted portions of the lining plates, to thereby prevent deterioration in the welding quality due to volatile components of concrete or the melting of concrete caused by thermal effects on the concrete building frame construction. Further, since thin lining plates can be used, it is possible not only to reduce the raw material cost, but also to improve the strength of portions joined by ordinary butt welding. In particular, when the area of lining plates needs to be small to meet certain construction conditions, a large number of back plates are necessary per unit area to be lined. In such a case, the effects of the present invention are remarkable. When plates made of titanium, which is a typical corrosion-resistant metal, are used in conventional butt welding, a shielding gas needs to be supplied to the backside of the butted portion, since titanium plates are readily oxidized because of their high oxygen affinity. However, in the lining structure of the present invention, titanium plates can be securely joined by TIG welding while suppressing oxidation, without supplying a shielding gas to the backside of the butted portion, and it is not necessary to use separate back plate members in addition to the lining plates, thereby improving the lining efficiency.

Examples of corrosion-resistant metallic materials include titanium, tantalum, niobium, hafnium, aluminum, nickel, etc.; corrosion-resistant alloys containing such metals as main components, stainless steel, etc.; metallic materials that have been made corrosion resistant by coating with corrosion-resistant materials or by surface treatment such as plating, PVD, CVD, or the like; etc. From the viewpoint of corrosion resistance and cost, titanium, and titanium alloys containing titanium as main components, stainless steel, etc., are preferable.

Titanium plates, which are a typical example of plates comprising the above-mentioned corrosion-resistant materials, can be used as the lining plates since the bent step portions are formed only at two opposite sides of each lining plate. That is, since rolled titanium plates can be bent only in a direction parallel to the rolling direction as mentioned above, it becomes possible to use titanium plates when they are bent in such a direction to form bent portions.

When a metallic material is used for the lining plates in the present invention, the method for forming bent portions is not limited to bending, and may be press forming, roll forming, hot forming, forging, or the like as long as the bent portions can be suitably formed.

Usable non-metallic materials include, for example, thermoplastic polymeric materials, such as polyethylene resins, polypropylene resins, polyamide resins, acrylic resins, polyvinyl chloride resins, etc.; plastic materials, such as phenol resins, urea resins, epoxy resins, and like thermosetting polymeric materials; and FRP materials, which are composite materials of unsaturated polyester resins and glass fibers. Use of such a material makes the panel lining application easy due to the light weight of the material, and further, when an elastic plastic material, such as a modified silicon resin, synthetic rubber resin, or natural rubber resin, is used, the lining material itself can impart flexibility, making it possible to bring the lining plates into closer contact with concrete framework constructions, steel constructions, and wood constructions to be lined.

When a fine ceramic material produced by sintering or otherwise processing alumina, magnesia, zirconia, silicon carbide, silicon nitride, a mixture thereof, or the like, or a ceramic material such as bricks, pottery and porcelain, glass, or the like produced by sintering or otherwise processing clay, silica rock, feldspar, or the like, is used as a non-metallic material, heat resistance, abrasion resistance, etc., can be imparted to the material to be lined. Such plastics and ceramics can be shaped by molding, extrusion, injection, tape casting, or other processes. Further, it is possible to achieve high protective lining effects using inexpensive materials, by compositing a metallic material and non-metallic material, such as a plastic, that advantageously affect each other's characteristics.

When the lining structure is used for lining a construction that comes into contact with a liquid, the successive lining plates can be disposed so as to have a smooth (flush) surface without projections or recesses, thereby reducing the resistance to flow. Further, when the supporting portions of the lining plates are bonded with an adhesive to the surface to be lined, the adhesive is covered with the supporting portions and covering portions and thus is not exposed. This prevents dissolution of toxic substances into the liquid, and the use of inexpensive adhesives with poor durability will not cause a problem. Moreover, anchor bolts, when used, are also not exposed, so that dissolution of toxic substances can be prevented and no problem will be caused even when using inexpensive anchor bolts with poor durability.

DESCRIPTION OF NUMERALS

Figure 1:
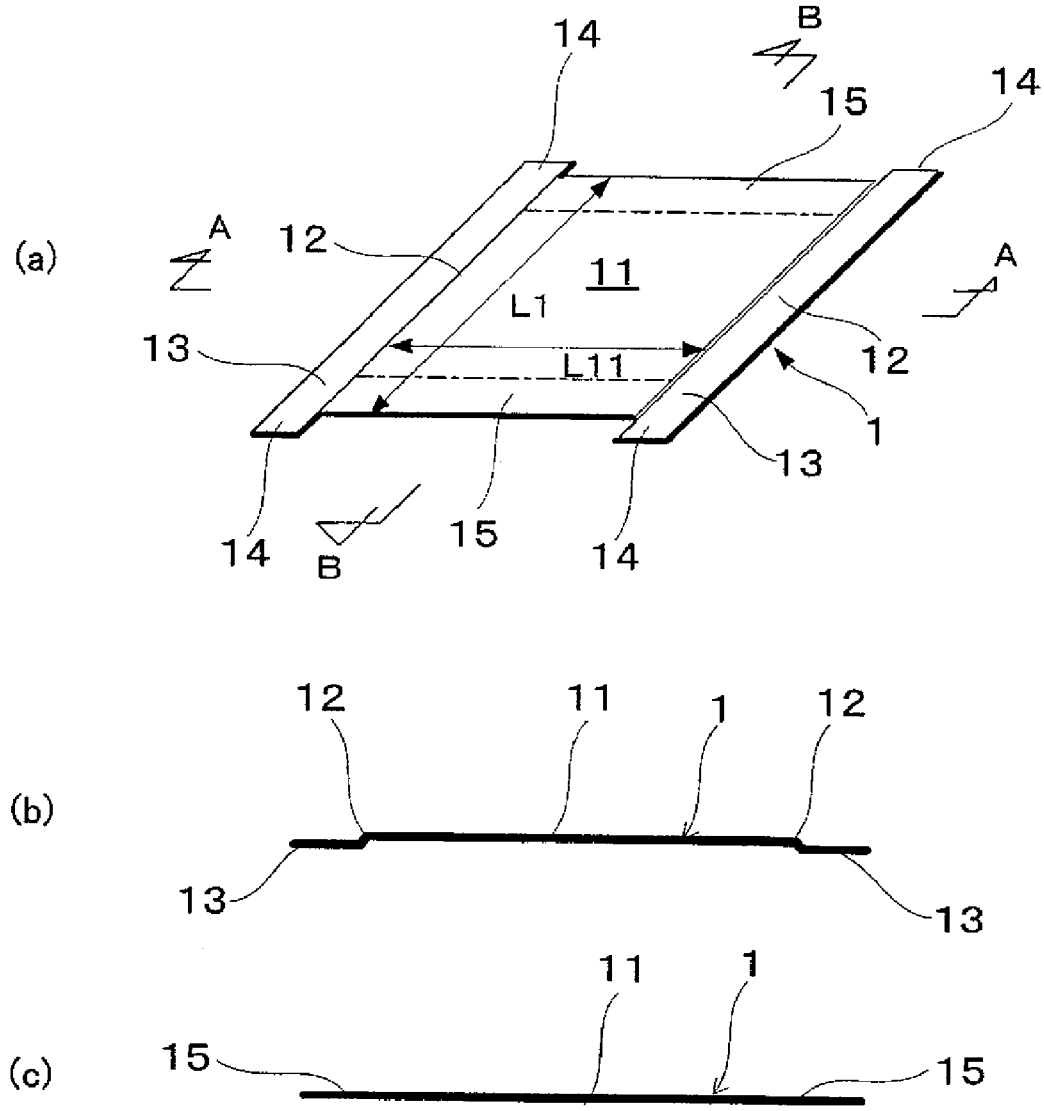
FIG. 1(*a*) is a perspective view showing a first lining plate of a first embodiment of the present invention; (*b*) is a sectional view taken along line A-A of (*a*); and (*c*) is a sectional view taken along line B-B of (*a*).
Figure 2:
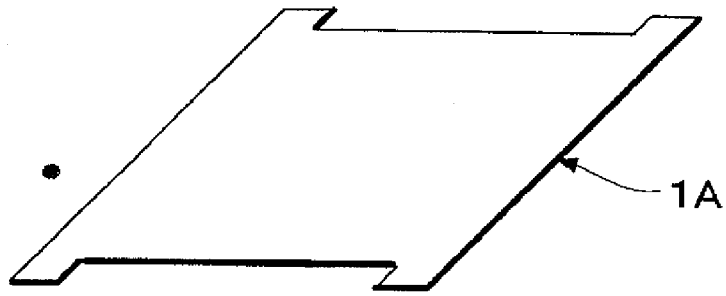
FIG. 2 is a perspective view showing the first lining plate before bending.

1 First lining plate
11 Lining plate body
12 Bent step portion
13 Supporting portion
14 Protruding portion
15 Covering portion
2 Second lining plate
21 Lining plate body
22 Bent step portion
23 Supporting portion
24 Introduction portion
25 Covering portion

BEST MODE FOR CARRYING OUT THE INVENTION

Preferable embodiments of the present invention are described below with reference to the drawings.

First Embodiment

FIGS. 1 to 6 show the first embodiment. The lining structure of this embodiment, which is intended to prevent corrosion, is configured using two types of lining plates, i.e., first lining plates 1 and second lining plates 2, which are all titanium alloy plates (an example of corrosion-resistant metal plates).

Each first lining plate 1 is formed by bending, as shown in FIG. 1, a nearly square corrosion-resistant material plate 1A (shown in FIG. 2) that has been shaped by punching. The first lining plate 1 has supporting portions 13 projecting outwardly from a lining plate body 11 at two opposite sides of the square lining plate body 11 via bent step portions 12; protruding portions 14 protruding from both ends of the supporting portions 13; and covering portions 15 formed at the remaining sides of the lining plate body 11. The lining plate body 11 and covering portions 15 are formed to be flush with each other. The boundaries of the lining plate body 11 and covering portions 15 are indicated by alternate long and short dashed lines.

Figure 3:
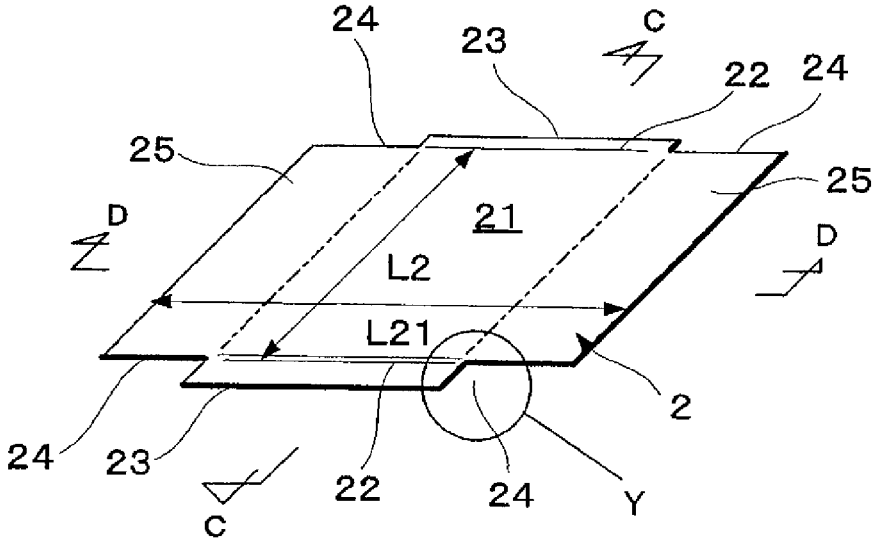
FIG. 3(*a*) is a perspective view showing a second lining plate of the first embodiment of the present invention; (*b*) is a sectional view taken along line C-C of (*a*); (*c*) is a sectional view taken along line D-D of (*a*); and (*d*) is an enlarged view of portion Y of (*a*).
Figure 3:
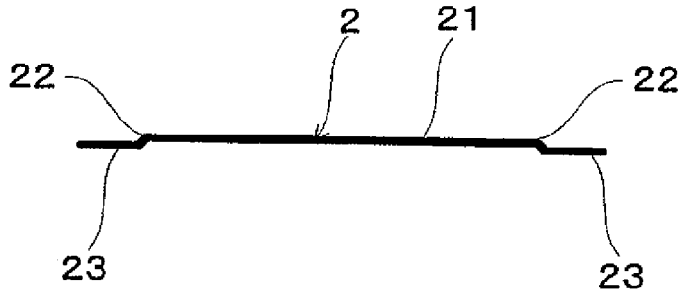
Figure 3:
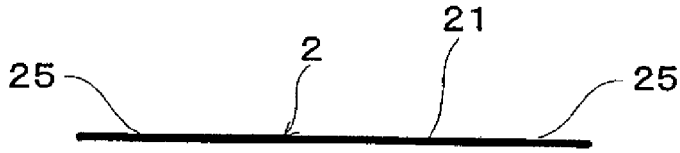
Figure 3:
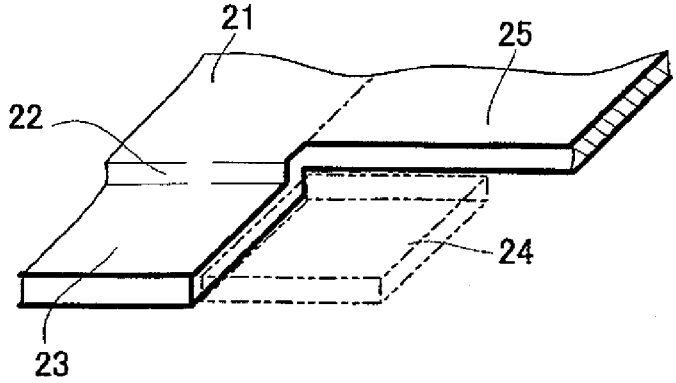
Figure 4:
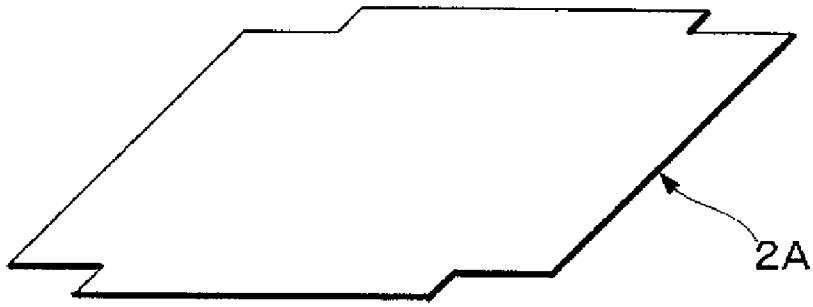
FIG. 4 is a perspective view showing the second lining plate before bending.

Each second lining plate 2 is formed by bending, as shown in FIG. 3, a nearly square corrosion-resistant material plate 2A (shown in FIG. 4) that has been shaped by punching. The second lining plate 2 has supporting portions 23 formed at two opposite sides of a square lining plate body 21 via bent step portions 22, and covering portions 25 formed at the remaining sides of the lining plate body 21. The space at the side of each end of each supporting portion 23 (the portion indicated by chain double-dashed lines), which has a different level from the covering portions 25, is used as an introduction portion 24 for introducing a supporting portion 13 and protruding portion 14 of the first lining plate 1. The lining plate body 21 and covering portions 25 are formed to be flush with each other, and the boundaries of the lining plate body 21 and covering portions 25 are indicated by alternate long and short dashed lines.

The length L1 including the covering portions 15 of the first lining plate 1 is the same as the length L2 of the lining plate body 21 of the second lining plate 2, and the length L11 of the lining plate body 11 of the first lining plate 1 is the same as the length L21 including the covering portions 25 of the second lining plate 2.

Examples of corrosion-resistant materials include titanium, tantalum, niobium, hafnium, aluminum, nickel, etc.; corrosion-resistant alloys containing such metals as main components, stainless steel, and the like; metallic materials that have been made corrosion resistant by coating with corrosion-resistant materials or by plating, PVD, CVD, or like surface treatment; etc. From the viewpoint of corrosion resistance and cost, titanium, titanium alloys containing titanium as a main ingredient, stainless steel, and the like are preferable.

Figure 5:
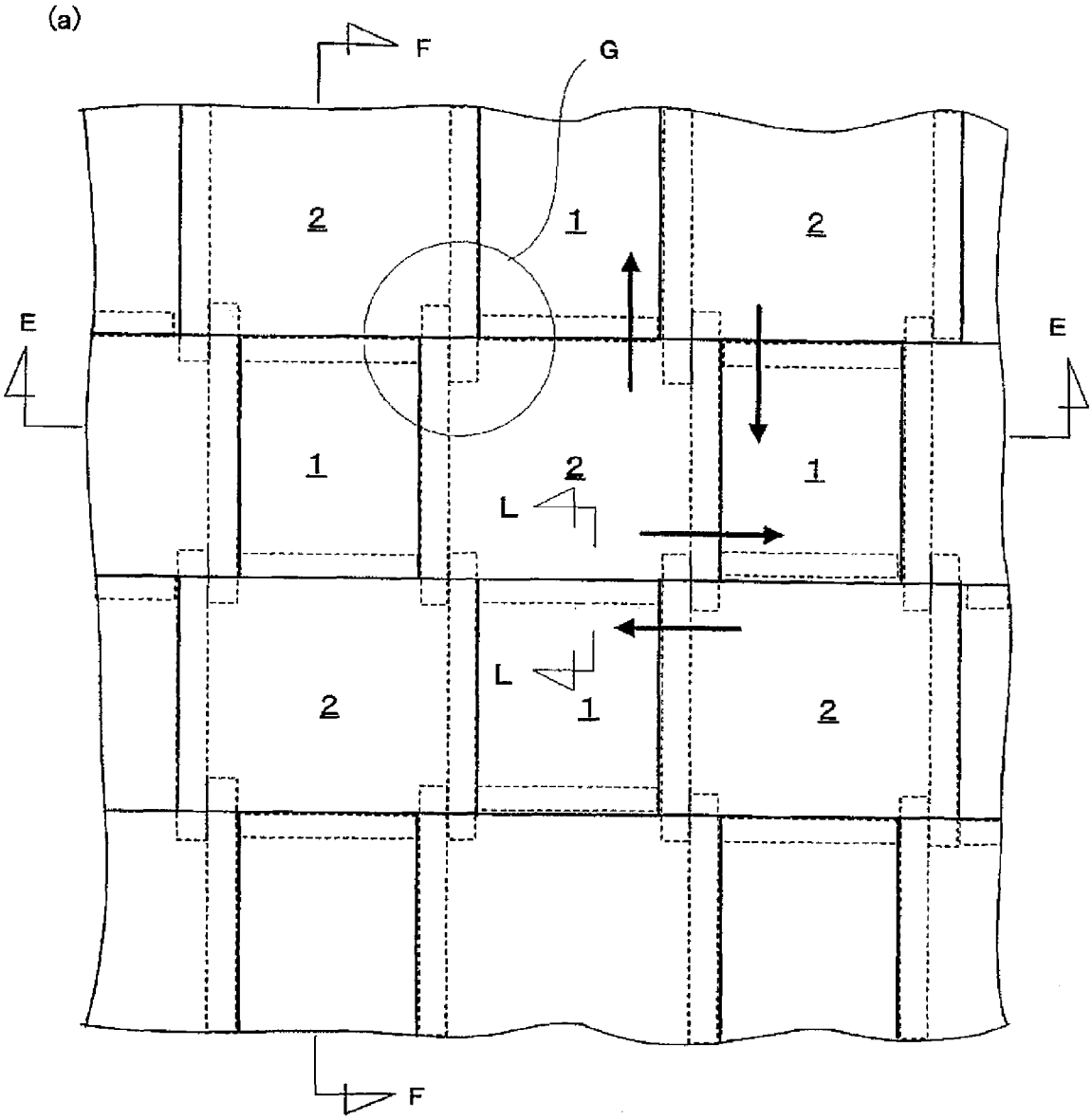
FIG. 5(*a*) is a front view of the first embodiment; (*b*) is a sectional view taken along line E-E of (*a*); and (*c*) is a sectional view taken along line F-F of (*a*).
Figure 5:
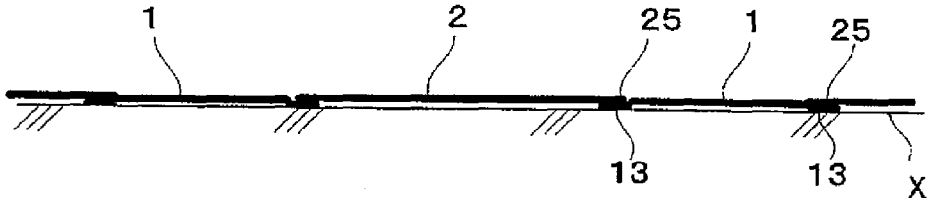
Figure 5:
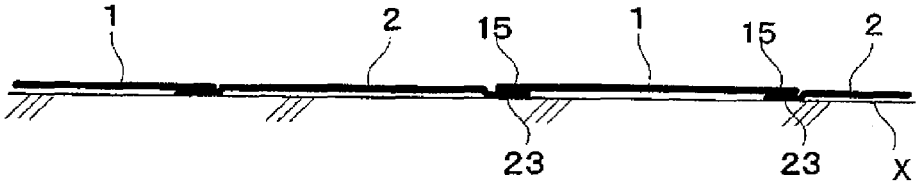

FIG. 5 shows first and second lining plates 1 and 2 disposed alternately in longitudinal and transverse directions to form a staggered pattern on an inner wall of a water treatment tank constructed from concrete, which is an example of a framework construction to be lined. The supporting portions 13, 23 and protruding portions 14 of the lining plates 1, 2 are fixed to the surface X to be lined, with anchors, adhesive layers, or a combination thereof (not shown).

The lining plates 1, 2 that are longitudinally or transversely adjacent to each other are disposed in such a manner that a covering portion 25 (15) of a lining plate 2 (1) is superposed on a supporting portion 13 (23) of another lining plate 1 (2) and that the lining plate body 11 (21) of the latter lining plate 1 (2) is butted against the covering portion 24 (15) of the former lining plate 2 (1). The butted portion is joined by TIG welding, with an adhesive, or a combination thereof.

Figure 6:
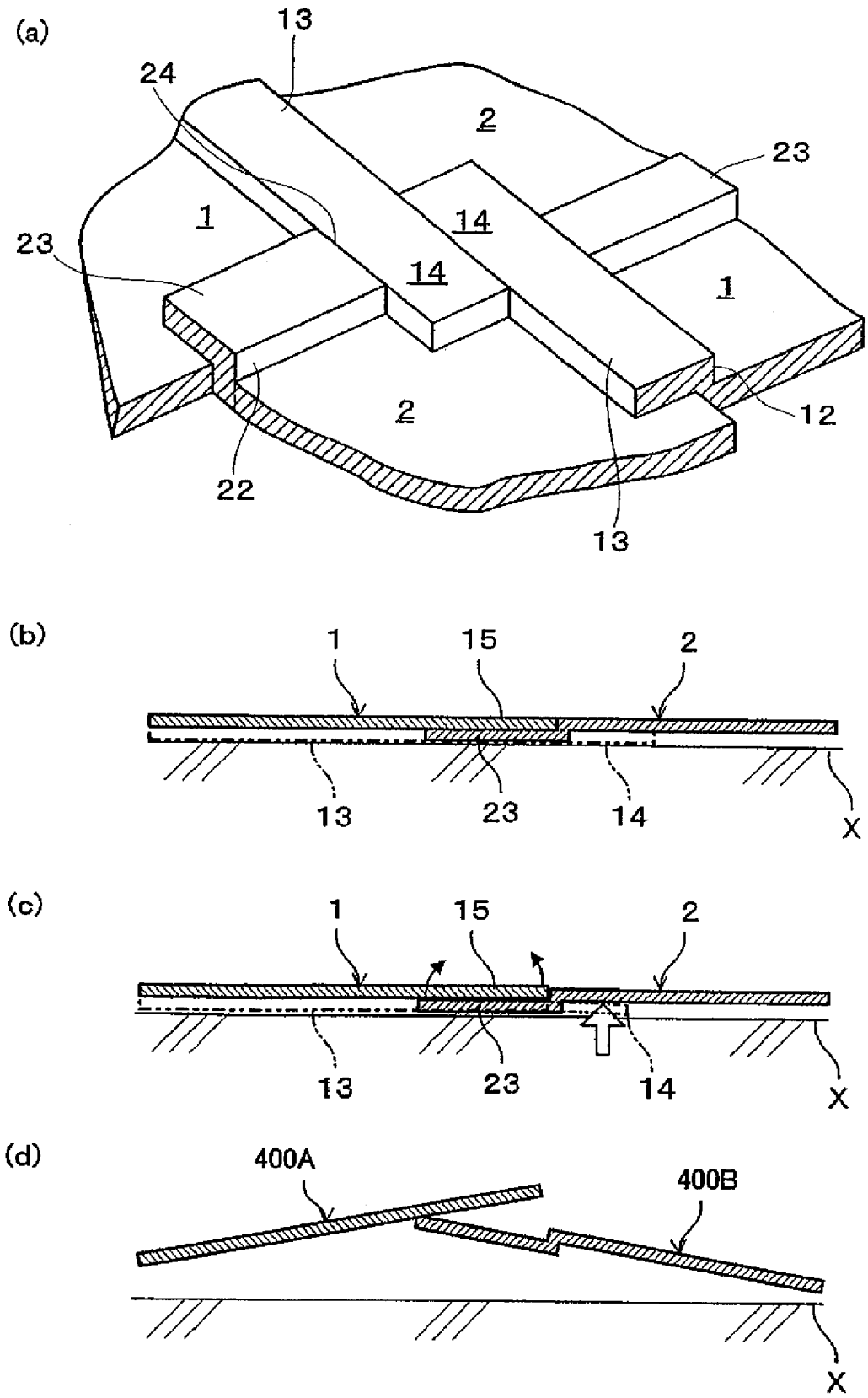
FIG. 6(*a*) is an enlarged perspective view seen from the backside of portion G of FIG. 5(*a*); (*b*) is a sectional view taken along line L-L of FIG. 5(*a*); (*c*) is an explanatory drawing of the action; and (*d*) is a comparative drawing.
Figure 7:
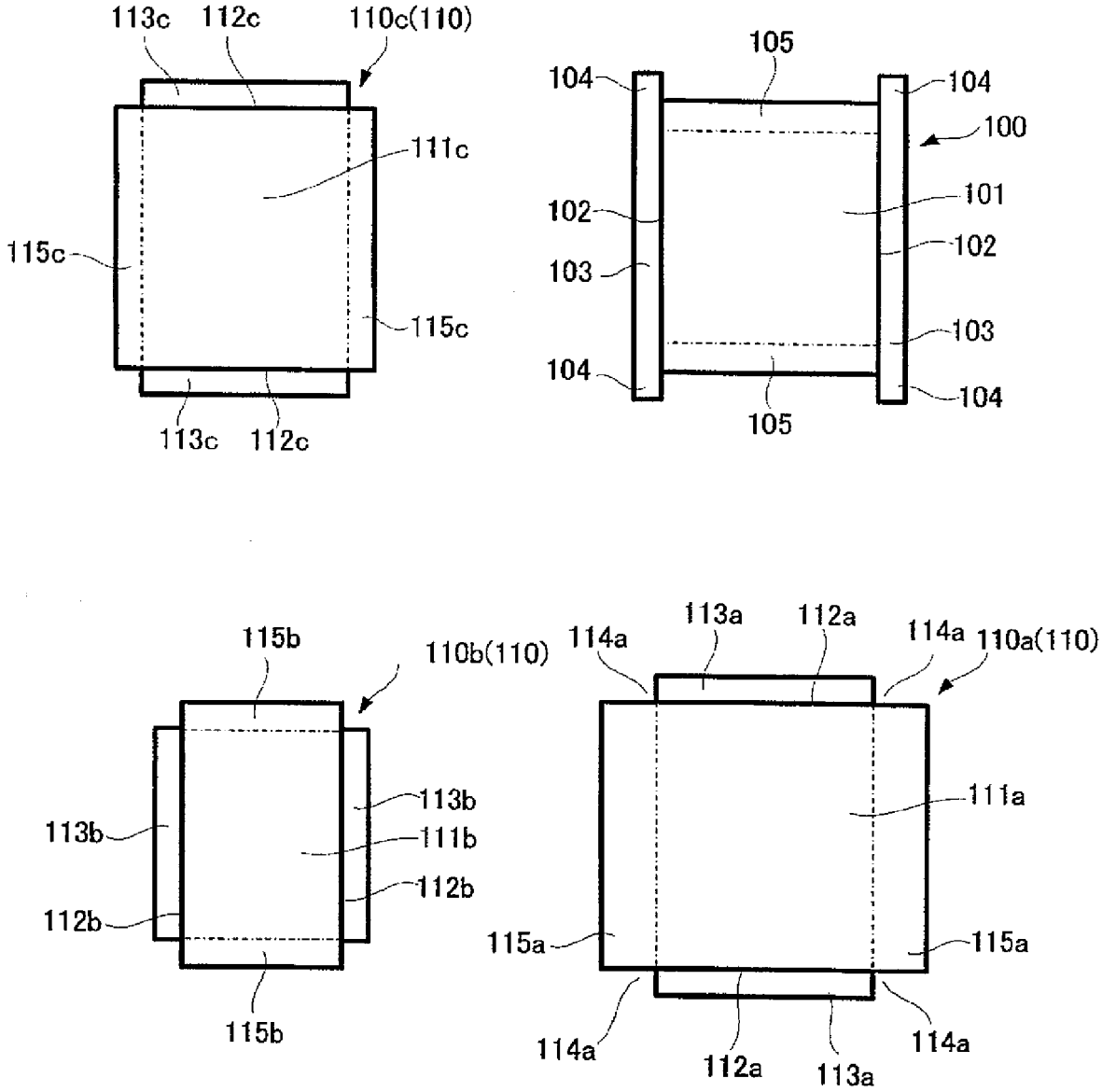
FIG. 7 is a front view showing a lining plate of a second embodiment of the present invention.

As shown in FIG. 6(*a*), protruding portions 14 of supporting portions 13 of first lining plates 1 are located at the backsides of covering portions 25 of second lining plates 2, passing through introduction portions 24 of the second lining plates 2, and ends of the supporting portions 13 are located in the introduction portions 24. The protruding portions 14 are located so as to intervene between an end of a supporting portion 23 of one of the second lining plates 2 and an end of a supporting portion 23 of another second lining plate 2 that is adjacent to the former second lining plate 2 in a diagonal direction.

As shown in FIG. 6, the supporting portions 13, 23 are arranged without being concentrated into a single point. Moreover, the adjacent supporting portions 13, 23 are positioned so as to mutually restrict their movement due to the presence of the protruding portions 14.

Such a staggered arrangement of the lining plate bodies 11, 12 of the first and second lining plates 1, 2 makes it possible to locate the lining plates 1, 2 of a certain row so as to straddle butted portions of the adjacent lining plates 1, 2 of a row adjacent to the former row, thereby achieving effective resistance to shear force. Further, as described above, the presence of the protruding portions 14 avoid a concentration of the supporting portions 13, 23 into a single point, and thereby allow external forces to be dispersed, making displacement of the lining plates 1, 2 unlikely. Furthermore, the protruding portions 14 are located on the backsides of the covering portions 25 of the second lining plates 2, passing through introduction portions 24 of the second lining plates 2. Therefore, when the lining plates 1, 2 are being lifted and peeled from the lined surface X as shown in FIG. 6(*c*) by an external force such as a seismic force or the like, the protruding portions 14 will come into contact with the backsides of the covering portions 25 of the lining plates 2 as indicated by the open arrow in FIG. 6(*c*), to thereby prevent lifting of the lining plates 1, 2 and loosening of the joints of the lining plates 1, 2. In contrast, lining plates 400A, 400B (shown in FIG. (d)) without protruding portions 14 easily lift due to the absence of protruding portions 14 which provide resistance to lifting.

The supporting portions 13, 23 can also be used to prevent displacement of the lining plates 1, 2. As a result, even when a shearing force or the like produced by an earthquake or other vibration acts as indicated by the arrows in FIG. 5, the supporting portions 13, 23 exhibit resistance to such a force, and prevent the degrease in watertightness caused by displacement of the lining plates 1, 2.

Design variations are possible for the dimensions of the first and second lining plates 1, 2, as long as the above-mentioned functions are exhibited. For example, the width of each of the supporting portions 13, 23 and protruding portions 14 is less than 50%, preferably 5 to 45%, and more preferably 10 to 20%, of the entire width of each of the lining plates 1, 2. The thickness of each lining plate is usually at least 0.01 mm, preferably 0.1 mm to 5.0 mm, and more preferably 0.5 mm to 2.0 mm.

Second Embodiment

FIGS. 7 to 10 show a second embodiment. The lining structure for corrosion prevention according to this embodiment is configured using two types of lining plates, i.e., first lining plates 100 and second lining plates 110, which are titanium alloy plates (an example of a corrosion-resistant material). Like the first lining plates 1 of the first embodiment, each first lining plate 100 has supporting portions 103 projecting outwardly from a square lining plate body 101 at two opposite sides of the lining plate body 101 via bent step portions 12; protruding portions 104 protruding from both ends of the supporting portions 103; and covering portions 105 formed at the remaining sides of the lining plate body 101.

The second lining plates 110 include three types of second lining plates 110*a*, 110*b*, 110*c*, which have different dimensions, and like the second lining plates 2 of the first embodiment, the second lining plates 110*a* to 110*c* have supporting portions 113*a* to 113*c* formed at two opposite sides of square lining plate bodies 111*a* to 111*c* via bent step portions 112*a* to 112*c*, and covering portions 115*a* to 115*c* formed at the remaining sides of the lining plate bodies 111*a* to 111*c*.

Further, as in the second lining plates 2 of the first embodiment, the spaces at the sides of the ends of the supporting portions 113*a* of the second lining plates 110*a*, the spaces having a different level from the covering portions 115*a*, are used as introduction portions 114*a* for introducing supporting portions 103 and protruding portions 104 of the first lining plates 100.

Figure 8:
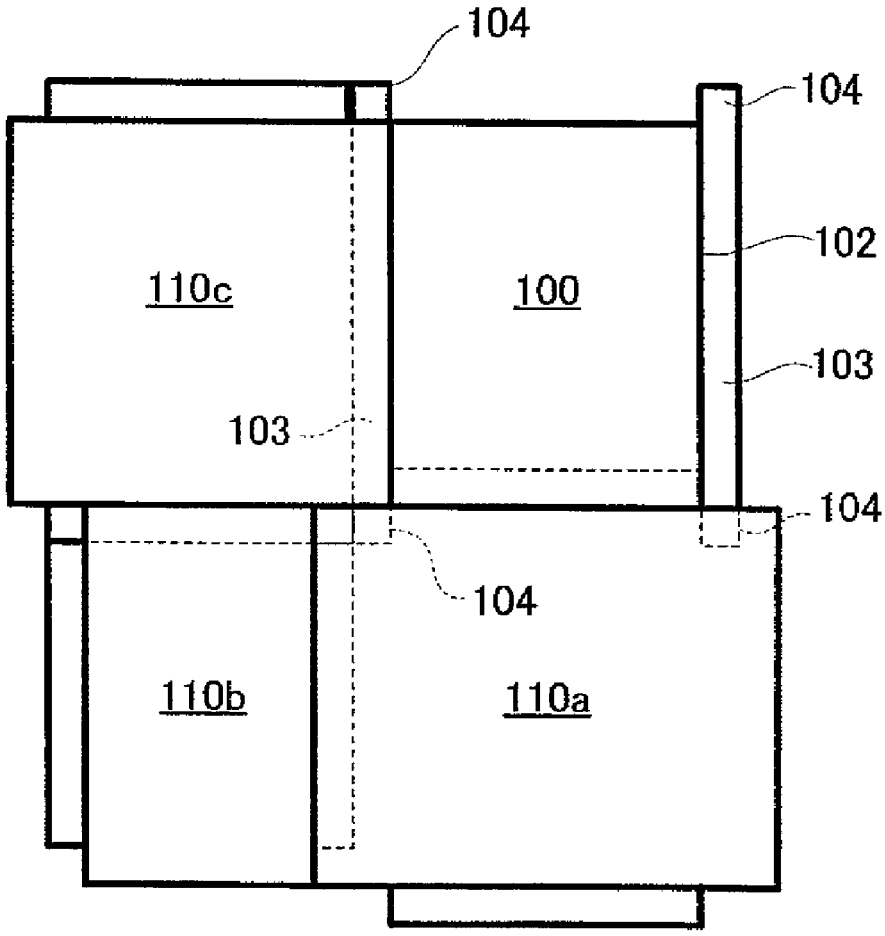
FIG. 8 is a front view of lining plates of the second embodiment when joined together.
Figure 9:
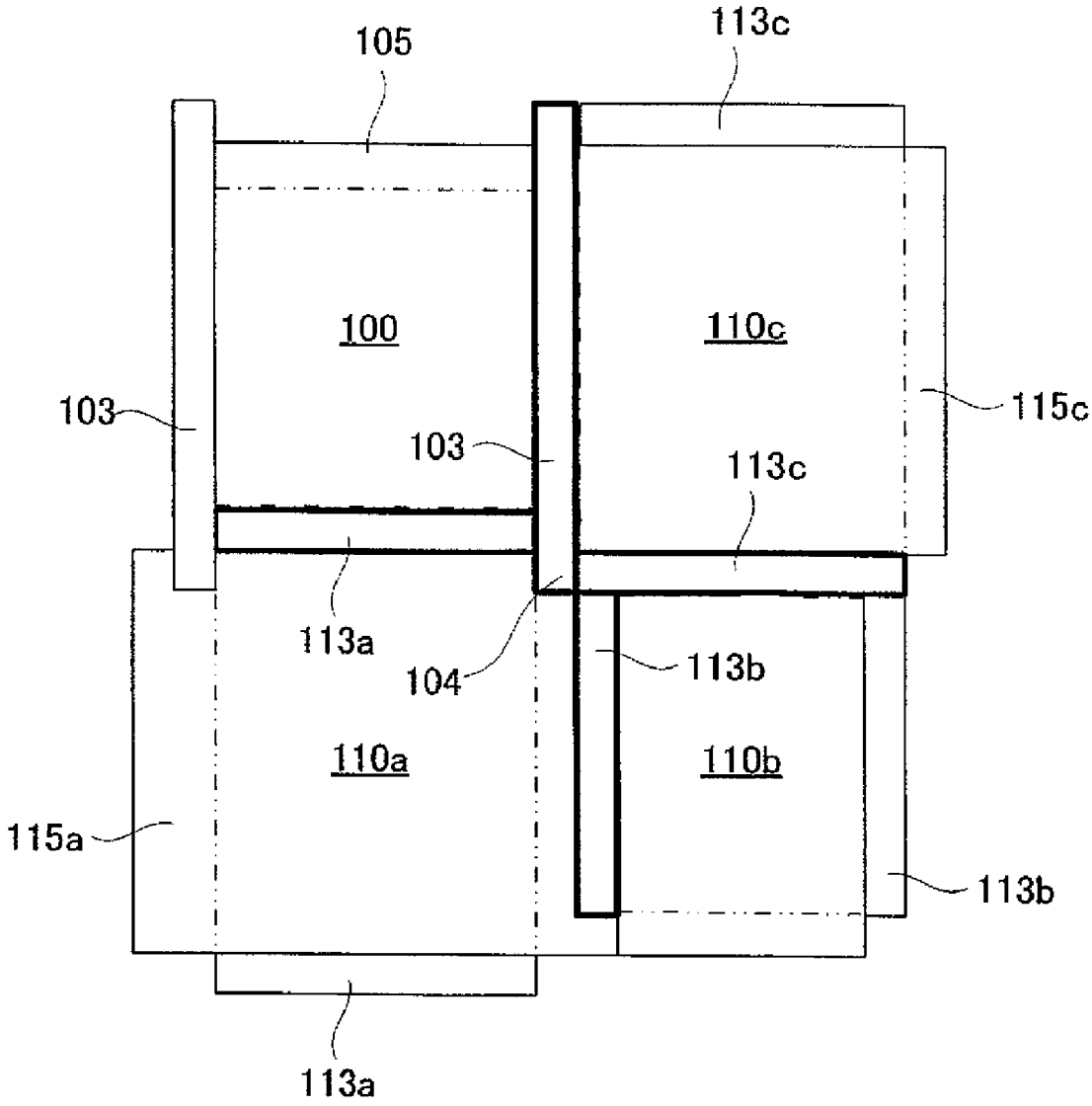
FIG. 9 is a back view of lining plates of the second embodiment when joined together.
Figure 10:
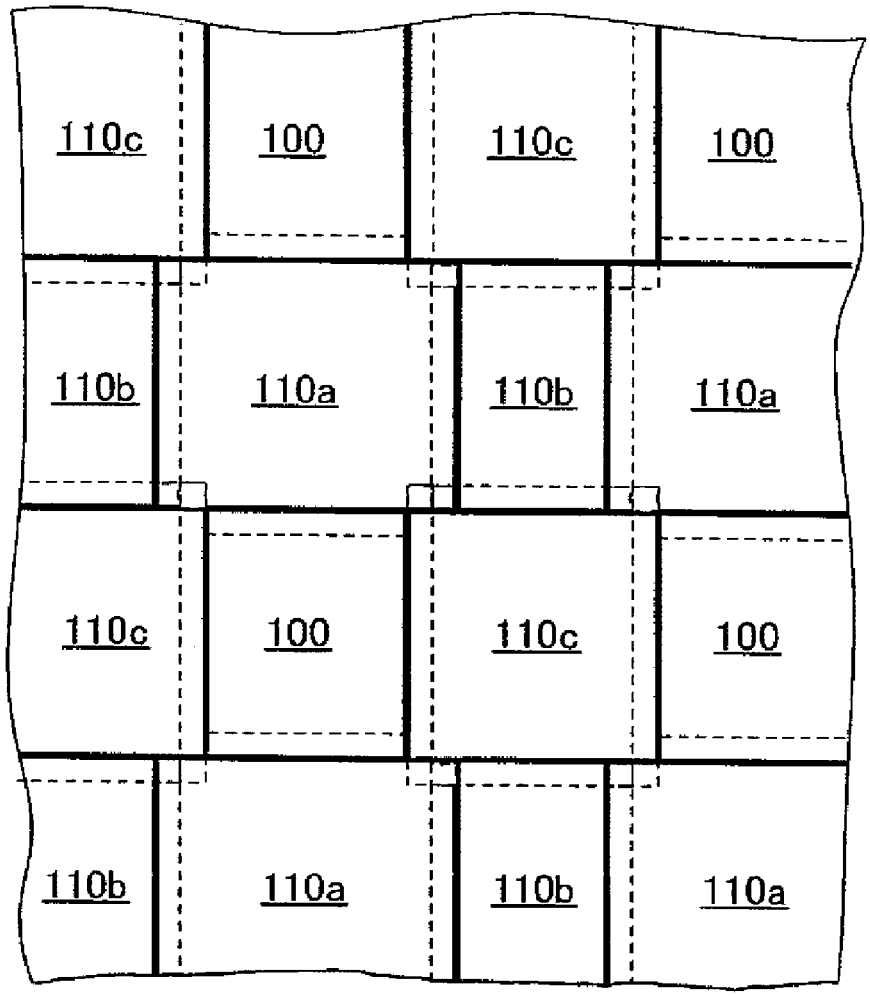
FIG. 10 is a front view showing the entirety of the lining plates of the second embodiment when joined together.

When the first and second lining plates 100, 110*a*-110*c* are disposed alternately in longitudinal and transverse directions to form a staggered pattern on an internal wall of a water treatment tank constructed of concrete, as shown in FIGS. 8 and 9, a covering portion of one of the lining plates that are longitudinally and transversely adjacent to each other is superposed on a supporting portion of another lining plate. Further, protruding portions 104 of supporting portions 103 of first lining plates 100 are located at the backsides of covering portions 115*a* of second lining plates 110*a*, passing through introduction portions 114*a* of the second lining plates 110*a*, and ends of supporting portions 103 of the first lining plates 100 are located at introduction portions 114*a* of the second lining plates 110*a*. Furthermore, as shown in FIG. 9 and other figures, protruding portions 104 of supporting portions 103 of the first lining plates 100 are located so as to intervene between an end of a supporting portion 113*a* of one of the second lining plate 110*a* and an end of a supporting portion 113*c* of another second lining plate 110*c* that is adjacent to the former second lining plate 110*a* in a diagonal direction. With such a configuration, the supporting portions 103, 113*a*-113*c* are arranged without being concentrated into a single point, and the adjacent supporting portions are positioned so as to mutually restrict their movement.

Moreover, as in the first embodiment, the lining plate body of each lining plate is butted against a covering portion of another lining plate, and the butted portion is joined by TIG welding, with an adhesive, or a combination thereof.

Third Embodiment

Figure 11:
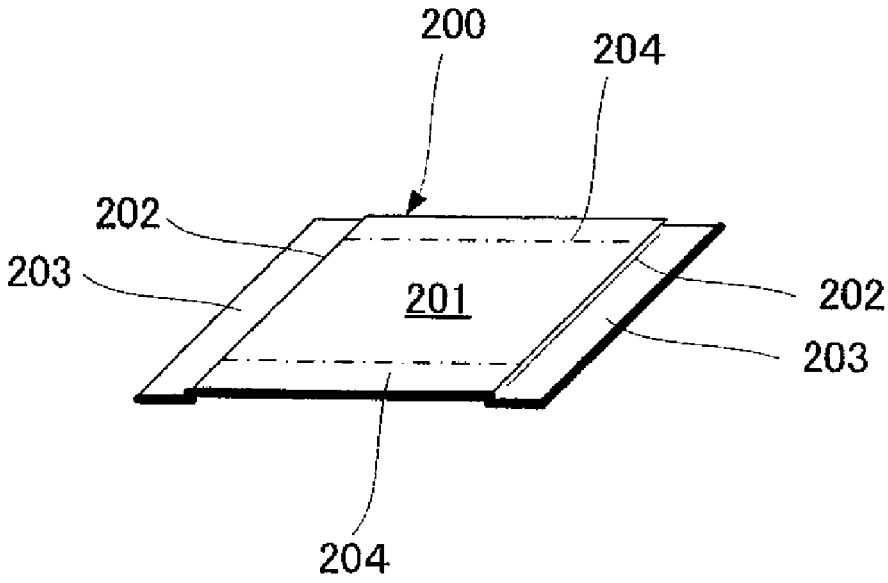
FIG. 11 is a perspective view showing a lining plate of a third embodiment of the present invention.
Figure 12:
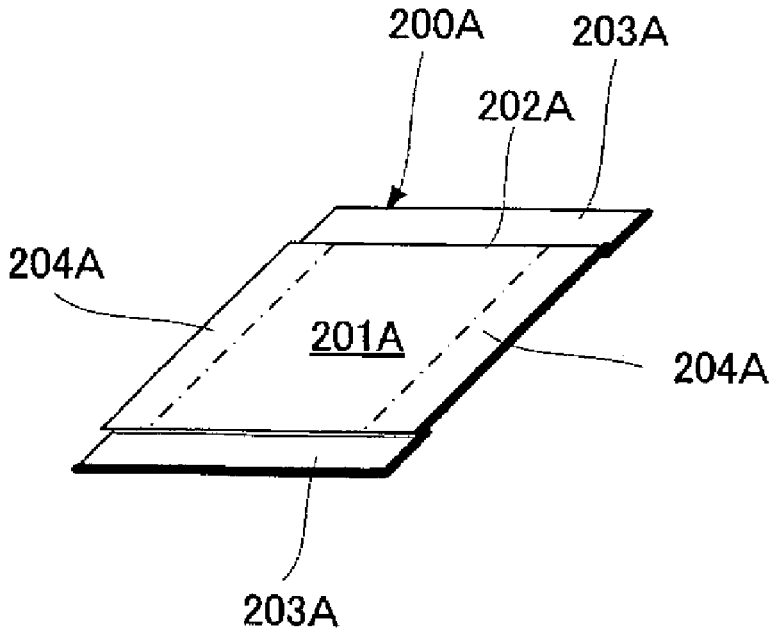
FIG. 12 is a perspective view of a lining plate of the third embodiment of the present invention.
Figure 13:
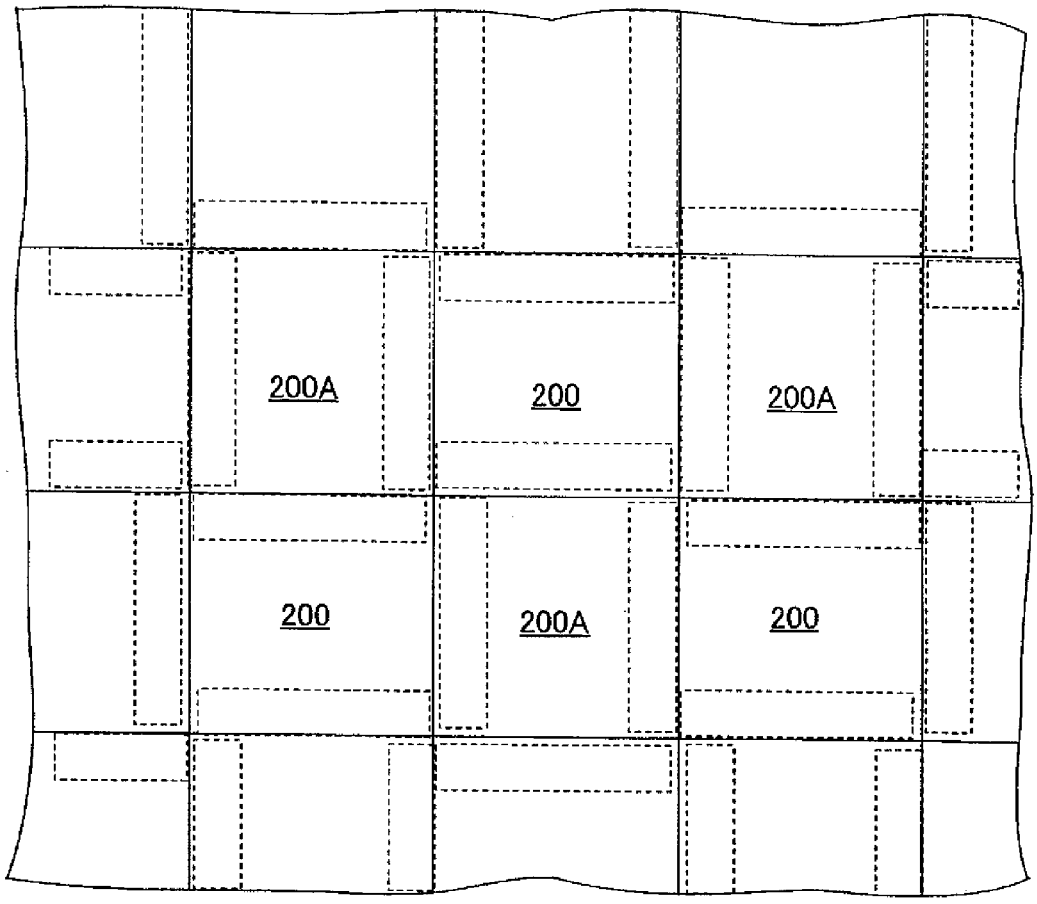
FIG. 13(*a*) is a front view showing the entirety of the lining plates of the third embodiment when joined together; (*b*) is a longitudinal sectional view of (*a*); and (*c*) is a transverse sectional view of (*a*).
Figure 13:
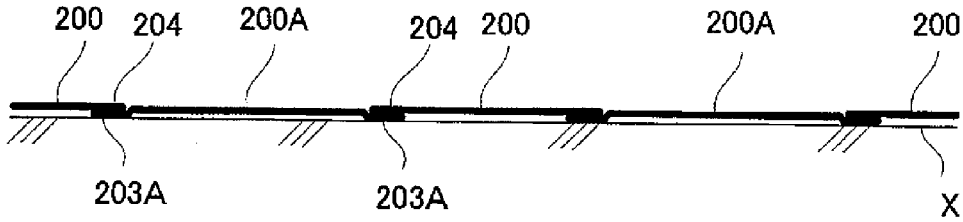
Figure 13:
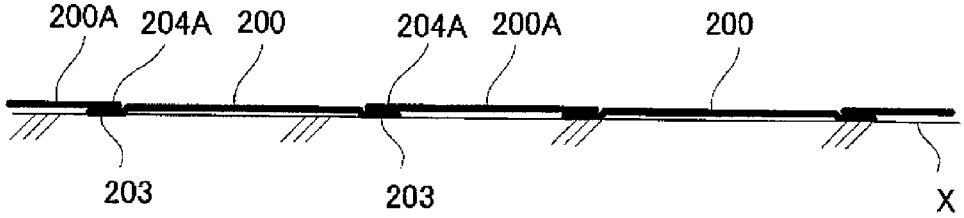

FIGS. 11 to 13 show a third embodiment, in which lining plates 200, 200A are each formed by bending a square corrosion-resistant material plate that has been shaped by punching; supporting portions 203, 203A are formed along the entire length of two opposite sides of square lining plate bodies 201, 201A via bent step portions 202, 202A; and unbent covering portions 204, 204A are provided at the remaining sides of the lining plate bodies 201, 201A. The lining plate bodies 201, 201A are formed to be flush with the covering portions 204, 204A.

These lining plates 200, 200A have the same dimensions, and are arranged in longitudinal and transverse directions as shown in FIG. 13. A covering portion 204A (204) of one of adjacent lining plates 200, 200A is superposed on a supporting portion 203 (203A) of the other lining plate; the lining plate body 201 (201A) of the latter lining plate is butted against the covering portion 204A (204) of the former lining plate; and the butted portion is joined by welding, adhesive, or a combination thereof. Thus, by providing the lining plates with supporting portions for joining and using the supporting portions as support plates (back plates) for the butted portions, oxidation can be suppressed to ensure good TIG welding, and the lining efficiency can be improved.

Further, since the supporting portions 203, 203A of the adjacent lining plates 200, 200A are in contact with and restrict each other to avoid displacement of the lining plates 200, 200A, the watertightness of the joints of the lining plates 200, 200A can be improved.

Fourth Embodiment

Figure 14:
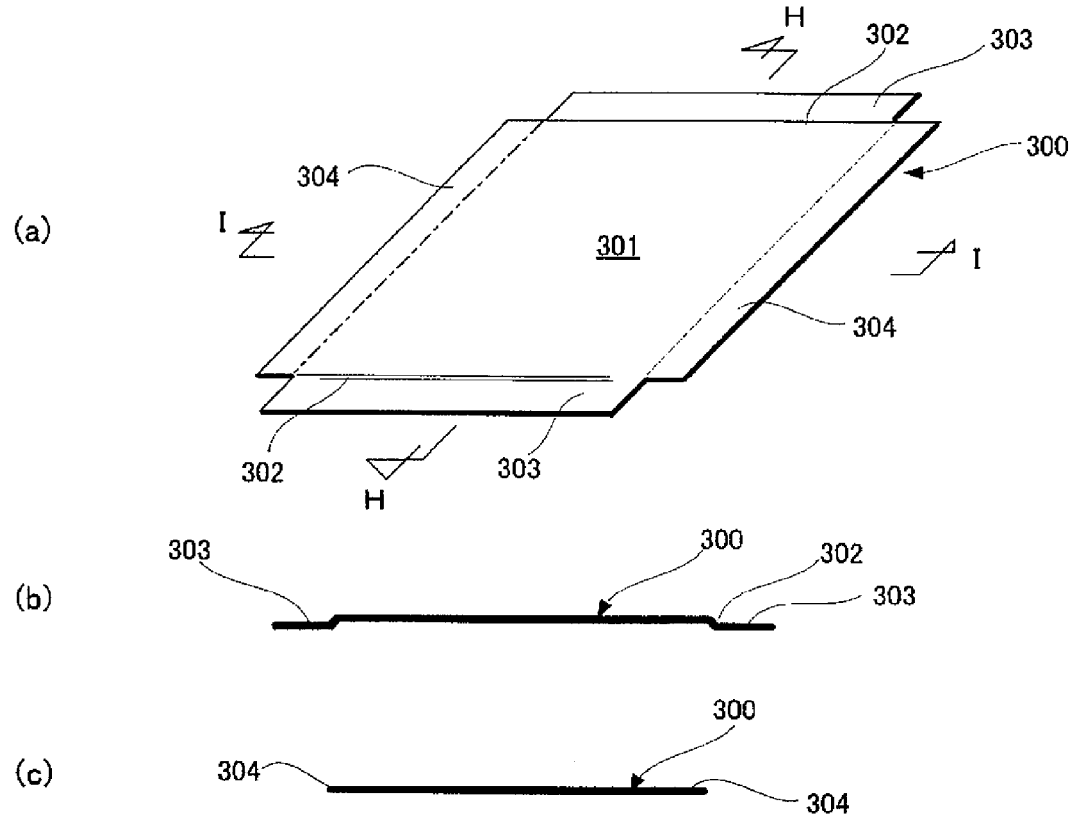
FIG. 14(*a*) is a perspective view showing a first lining plate of a fourth embodiment of the present invention; (*b*) is a sectional view taken along line H-H of (*a*); and (*c*) is a sectional view taken along line I-I of (*a*).
Figure 15:
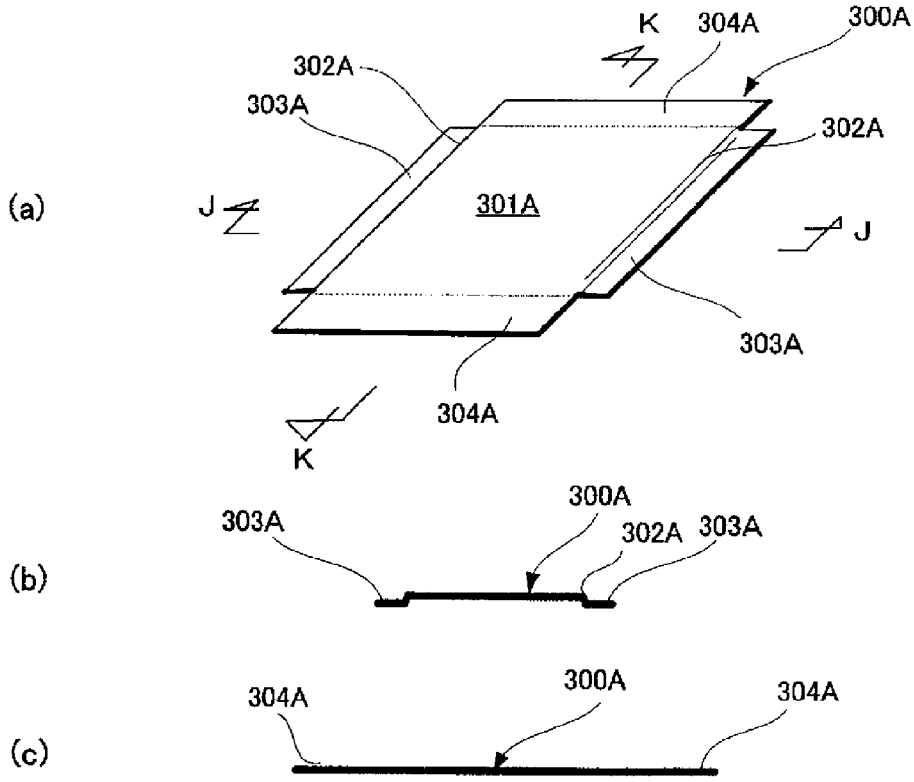
FIG. 15(*a*) is a perspective view showing a second lining plate of the fourth embodiment of the present invention; (*b*) is a sectional view taken along line J-J of (*a*); and (*c*) is a sectional view taken along line K-K of (*a*).
Figure 16:
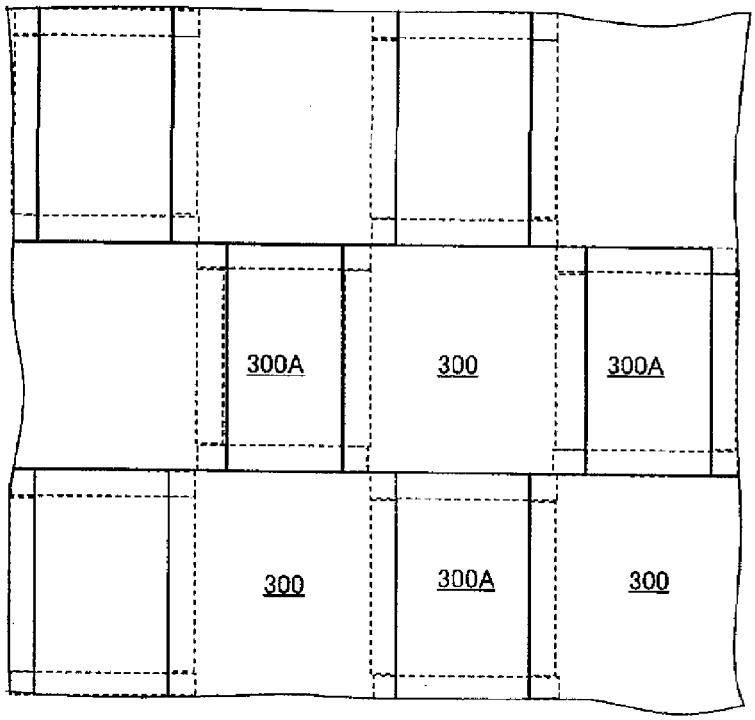
FIG. 16(*a*) is a front view showing the entirety of the lining plates of the fourth embodiment when joined together; (*b*) is a longitudinal sectional view of (*a*); and (*c*) is a transverse sectional view of (*a*).
Figure 16:
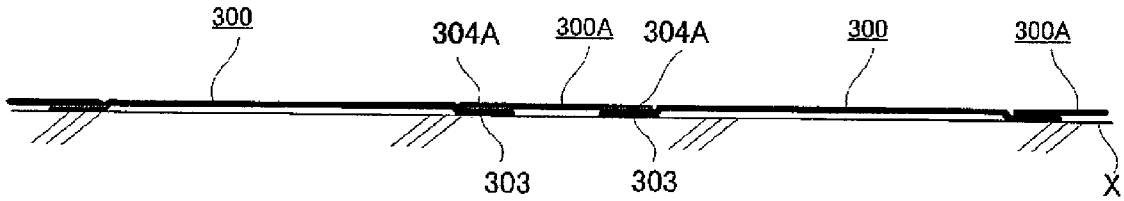
Figure 16:
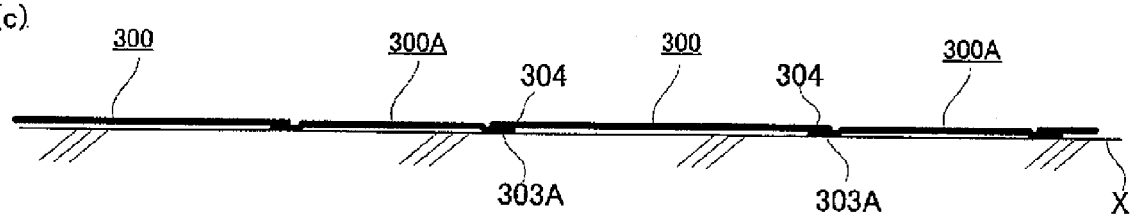

FIGS. 14 to 16 show a fourth embodiment, in which lining plates 300, 300A are each formed by bending a nearly square corrosion-resistant metal plate that has been shaped by punching; supporting portions 303, 303A are formed at two opposite sides of square lining plate bodies 301, 301A via bent step portions 302, 302A; and unbent covering portions 304, 304A are formed at the remaining sides of the lining plate bodies 301, 301A. The lining plate bodies 301, 301A are formed to be flush with the covering portions 304, 304A.

The lining plates 300, 300A are similar to the lining plates of the third embodiment in that the lining plate body 301 (301A) of one of the lining plates is butted against a covering portion 304A (304) of another lining plate as shown in FIG. 16, and in that the butted portion is joined by welding, with an adhesive, or a combination thereof; but are different from the third embodiment in that the lining plates 300, 300A have different dimensions from each other so as to form a staggered arrangement as shown in FIG. 16.

In all of the first to fourth embodiments described above, the lining plates are bent only in a direction parallel to the rolling direction.

Usable adhesives include those having high adhesion, which can be arbitrarily selected from epoxy adhesives, acrylic adhesives, silicon adhesives, modified silicon adhesives, natural rubber adhesives, synthetic rubber adhesives, urethane adhesives, polymer cements, etc. When the physical properties, such as thermal expansion coefficient and the like, of the corrosion-resistant metal used in the lining plates are different from those of the material to be lined, silicon adhesives, modified silicon adhesives, natural rubber adhesives, synthetic rubber adhesives, and like adhesives that have excellent flexibility as well as high adhesion are preferable. The surface to be lined may be formed of a steel material.

The front and rear surfaces of the lining plates may be inverted, so as to apply the lining plates in such a manner that the lining plate bodies are directly fixed to the surface to be lined and the supporting portions are separate from the surface to be lined.

The above embodiments show lining plates that are formed from corrosion-resistant materials in order to prevent corrosion, but the material of the lining plates is not limited thereto, and various materials mentioned above can be employed depending on the purpose of the lining. When a metallic material is used, a material having abrasion resistance, heat resistance, or other protective properties, such as an abrasion-resistant alloy, heat-resistant alloy, or the like, is preferable. Further, it is preferable that such a material also have good design properties in terms of texture and the like. Moreover, depending on the type of metal and other factors, various metal processing methods can be used, including bending processes such as press-bending, folding, etc.; forging processes; etc. The surfaces of the lining plates may be coated or plated.

The lining plates may be formed from a non-metallic material or from a composite of metallic and non-metallic materials. For example, plates formed from ceramics can be used for parts that require fire resistance, heat resistance, abrasion resistance, melting damage resistance, and like properties. Typical ceramics include fine ceramics produced by sintering alumina, beryllia, mullite, steatite, magnesia, or mixtures thereof; ceramics, such as bricks, pottery and porcelain, glass, and the like, that are produced by sintering or otherwise processing clay, silica, feldspar, and the like; etc. Usable methods for shaping ceramics include slurry casting, compression molding, extrusion, etc. Further, plastic plates, such as rigid vinyl chloride and the like, are less expensive than metals and metal alloys, and can be selected based on their characteristics since they are made of various types of resin. Moreover, reinforced plastics (FRPs) can be used for parts that require mechanical strength. Various forming methods can be employed depending on the type of plastic.

The invention claimed is:

1. A lining structure comprising lining plates each having supporting portions along the entire length of two opposite sides of a square lining plate body via bent step portions, and covering portions along the entire length of the remaining sides of the lining plate body, wherein the covering portions are flush with the lining plate body on an upper and lower surface;

the lining plates being arranged in longitudinal and transverse directions on a surface to be lined;

in the lining plates that are adjacent to each other in longitudinal and transverse directions, a covering portion of one of the lining plates being superposed directly over the entire length of a supporting portion of, and being butted against a lining plate body of, another of the adjacent lining plates, with the butted portion being joined by welding, with an adhesive, or a combination thereof, and the covering portion of the one of the lining plates and the butted lining plate body of the another of the lining plates providing a substantially flush surface;

wherein the lining plates include first and second lining plates;

wherein the first and second lining plates each have supporting portions extending from two opposite sides of a square lining plate body via bent step portions, and covering portions extending from the remaining sides of the lining plate body;

wherein each first lining plate has protruding portions extending from the ends of the supporting portions in extending directions of the supporting portion-bearing sides of the lining plate body;

wherein each second lining plate has spaces that are located at the sides of the ends of the supporting portions and that have a different level from the covering portions, the spaces being used as introduction portions for introducing supporting portions and protruding portions;

wherein the first and second lining plates are arranged alternately in longitudinal and transverse directions to form a staggered pattern;

wherein in the first and second lining plates that are adjacent to each other in longitudinal and transverse directions, a covering portion of one of the lining plates is superposed on a supporting portion of, and is butted against the lining plate body of, another of the lining plates; and wherein a protruding portion of a supporting portion of the first lining plates underlies a covering portion of the second lining plates through an introduction portion of the second lining plate, and is located between ends of supporting portions of the second lining plates that are adjacent to each other in a diagonal direction, so that the supporting portions and protruding portions restrict the movement of the lining plates.

2. The lining structure according to claim 1, wherein each lining plate is formed by bending a square or nearly square corrosion-resistant metal plate.

3. The lining structure according to claim 1, wherein the lining plates comprise a corrosion-resistant metallic material, a corrosion-resistant alloy material containing a corrosion-resistant metal as a main component, or a metallic material that has been made corrosion-resistant by coating with a corrosion-resistant material or by surface treatment; and wherein the bent step portions are formed by bending in a rolling direction.

4. The lining structure according to claim 1, wherein the lining plates comprise titanium.

5. The lining structure according to claim 1, wherein the lining plates comprise stainless steel.

6. The lining structure according to claim 1, wherein the lining plates comprise a metallic material that has protective properties.

7. The lining structure according to claim 6, wherein each of the lining plates is formed by bending a square or nearly square metal plate.

8. The lining structure according to claim 1, wherein the lining plates comprise a non-metallic material, or a composite of a metallic material and a non-metallic material, the non-metallic material or composite having protective properties.

9. The lining structure according to claim 8, wherein the non-metallic material is a plastic, an FRP, or a ceramic.

10. The lining structure according to claim 1, wherein the surface to be lined is an internal or external surface of a concrete construction, or both.

11. The lining structure according to claim 1, wherein the surface to be lined is an internal or external surface of a steel construction, or both.

12. The lining structure according to claim 1, wherein the surface to be lined is an internal or external surface of a wood construction, or both.

13. The lining structure according to claim 2, wherein the lining plates comprise a corrosion-resistant metallic material, a corrosion-resistant alloy material containing a corrosion-resistant metal as a main component, or a metallic material that has been made corrosion-resistant by coating with a corrosion-resistant material or by surface treatment; and wherein the bent step portions are formed by bending in a rolling direction.

14. The lining structure according to claim 3, wherein the lining plates comprise titanium.

* * * * *

UNITED STATES PATENT AND TRADEMARK OFFICE

CERTIFICATE OF CORRECTION

PATENT NO. : 7,980,036 B2
APPLICATION NO. : 11/576809
DATED : July 19, 2011
INVENTOR(S) : Teruki Takayasu et al.

It is certified that error appears in the above-identified patent and that said Letters Patent is hereby corrected as shown below:

On the title page: Item [73] Assignee, add -- Taisei Corporation (JP) -- as a second Assignee.

Signed and Sealed this
Tenth Day of April, 2012

David J. Kappos

David J. Kappos
*Director of the United States Patent and Trademark Office*